US011105516B2

(12) United States Patent
Chothave et al.

(10) Patent No.: US 11,105,516 B2
(45) Date of Patent: Aug. 31, 2021

(54) PANEL FOR AN HVAC SYSTEM

(71) Applicant: Johnson Controls Technology Company, Auburn Hills, MI (US)

(72) Inventors: Amit R. Chothave, Nashik (IN); Karan Garg, Pune (IN); Stephen C. Wilson, Oklahoma City, OK (US); Sriram Ramanujam, Pune (IN)

(73) Assignee: Johnson Controls Technology Company, Auburn Hills, MI (US)

( * ) Notice: Subject to any disclaimer, the term of this patent is extended or adjusted under 35 U.S.C. 154(b) by 165 days.

(21) Appl. No.: 16/430,303

(22) Filed: Jun. 3, 2019

(65) Prior Publication Data

US 2020/0378626 A1 Dec. 3, 2020

(51) Int. Cl.

| | |
|---|---|
| ***F24F 1/02*** | (2019.01) |
| ***F24F 1/022*** | (2019.01) |
| ***F24F 1/0326*** | (2019.01) |
| ***F24F 1/029*** | (2019.01) |

(52) U.S. Cl.

CPC ..... *F24F 1/02* (2013.01); *F24F 1/022* (2013.01); *F24F 1/029* (2019.02); *F24F 1/0326* (2019.02)

(58) Field of Classification Search

CPC .. F24F 1/02; F24F 1/0326; F24F 1/029; F24F 1/022

USPC ..... 62/259.1

See application file for complete search history.

(56) References Cited

U.S. PATENT DOCUMENTS

| | | | | |
|---|---|---|---|---|
| 2,130,327 | A * | 9/1938 | Galson | F24F 1/022 62/262 |
| 5,199,276 | A * | 4/1993 | Sullivan | F24F 1/0007 62/291 |
| 6,260,374 | B1 | 7/2001 | Smith et al. | |
| 6,497,256 | B1 | 12/2002 | Adams et al. | |
| 6,585,484 | B2 | 7/2003 | Rosenthal et al. | |
| 6,974,383 | B2 | 12/2005 | Lewis et al. | |
| 7,004,536 | B2 * | 2/2006 | Wieber | B62D 25/06 296/146.6 |
| 7,100,388 | B2 | 9/2006 | Kim et al. | |
| 7,526,903 | B2 | 5/2009 | Kandasamy | |
| 7,757,510 | B2 | 7/2010 | Rosete et al. | |
| 8,056,352 | B2 | 11/2011 | Kang et al. | |
| 8,282,452 | B2 | 10/2012 | Grigsby et al. | |
| 8,770,340 | B2 | 7/2014 | Cursetjee | |
| 9,696,046 | B2 | 7/2017 | Stewart et al. | |
| 9,759,446 | B2 | 9/2017 | Stewart et al. | |
| 9,964,330 | B2 | 5/2018 | Son et al. | |
| 2007/0170827 | A1 | 7/2007 | Frenia et al. | |

(Continued)

FOREIGN PATENT DOCUMENTS

| | | |
|---|---|---|
| CN | 205245488 U | 5/2016 |
| CN | 205481645 U | 8/2016 |

(Continued)

*Primary Examiner* — Ana M Vazquez

(74) *Attorney, Agent, or Firm* — Fletcher Yoder, P.C.

(57) ABSTRACT

A panel assembly for a heating, ventilation, and/or air conditioning (HVAC) system includes a base panel having a sheet and a flange formed around a perimeter of the sheet, where the flange includes a plurality of openings, a stiffener bracket configured to couple to the flange and reinforce the base panel, and a liner panel configured to couple to the flange and reinforce the base panel, where the plurality of openings is configured to interchangeably couple to the stiffener bracket and the liner panel.

29 Claims, 10 Drawing Sheets

(56) References Cited

U.S. PATENT DOCUMENTS

| | | | |
|---|---|---|---|
| 2008/0141710 | A1 | 6/2008 | Liu et al. |
| 2010/0206514 | A1 | 8/2010 | Liu et al. |
| 2015/0016808 | A1 | 1/2015 | Yamaguchi et al. |
| 2015/0023728 | A1 | 1/2015 | Buswell |
| 2018/0073767 | A1 | 3/2018 | Carton et al. |
| 2018/0080677 | A1 | 3/2018 | Carton et al. |
| 2018/0080678 | A1 | 3/2018 | Carton et al. |
| 2018/0094830 | A1 | 4/2018 | Ikeda et al. |

FOREIGN PATENT DOCUMENTS

| | | | |
|---|---|---|---|
| WO | 2017149341 | A1 | 9/2017 |
| WO | 2017149342 | A1 | 9/2017 |

* cited by examiner

PANEL FOR AN HVAC SYSTEM

BACKGROUND

The present disclosure relates generally to a heating, ventilation, and/or air conditioning (HVAC) system, and more particularly, to an adjustable panel for a housing of an HVAC system.

HVAC systems are utilized in residential, commercial, and industrial environments to control environmental properties, such as temperature and humidity, for occupants of the respective environments. The HVAC system may control the environmental properties through control of an air flow delivered to the environment. In some cases, the HVAC system may include a housing configured to enclose various components of the HVAC system. The housing may include an access panel that enables an operator to perform maintenance, clean, replace, and/or otherwise access the components within the housing. Existing HVAC systems may include a single wall access panel or a double walled access panel that are separately manufactured components for assembly to the housing. For example, the access panel may include a single wall that exposes insulation of the access panel to an interior of the housing. However, under certain circumstances, it may be desirable to clean the access panel, such that the insulation is covered by an additional liner to form the double walled access panel. Unfortunately, in existing HVAC systems, the single wall access panel and the double walled access panel are manufactured as separate components, which increases manufacturing and/or assembly costs of the HVAC system.

SUMMARY

Figure 1:
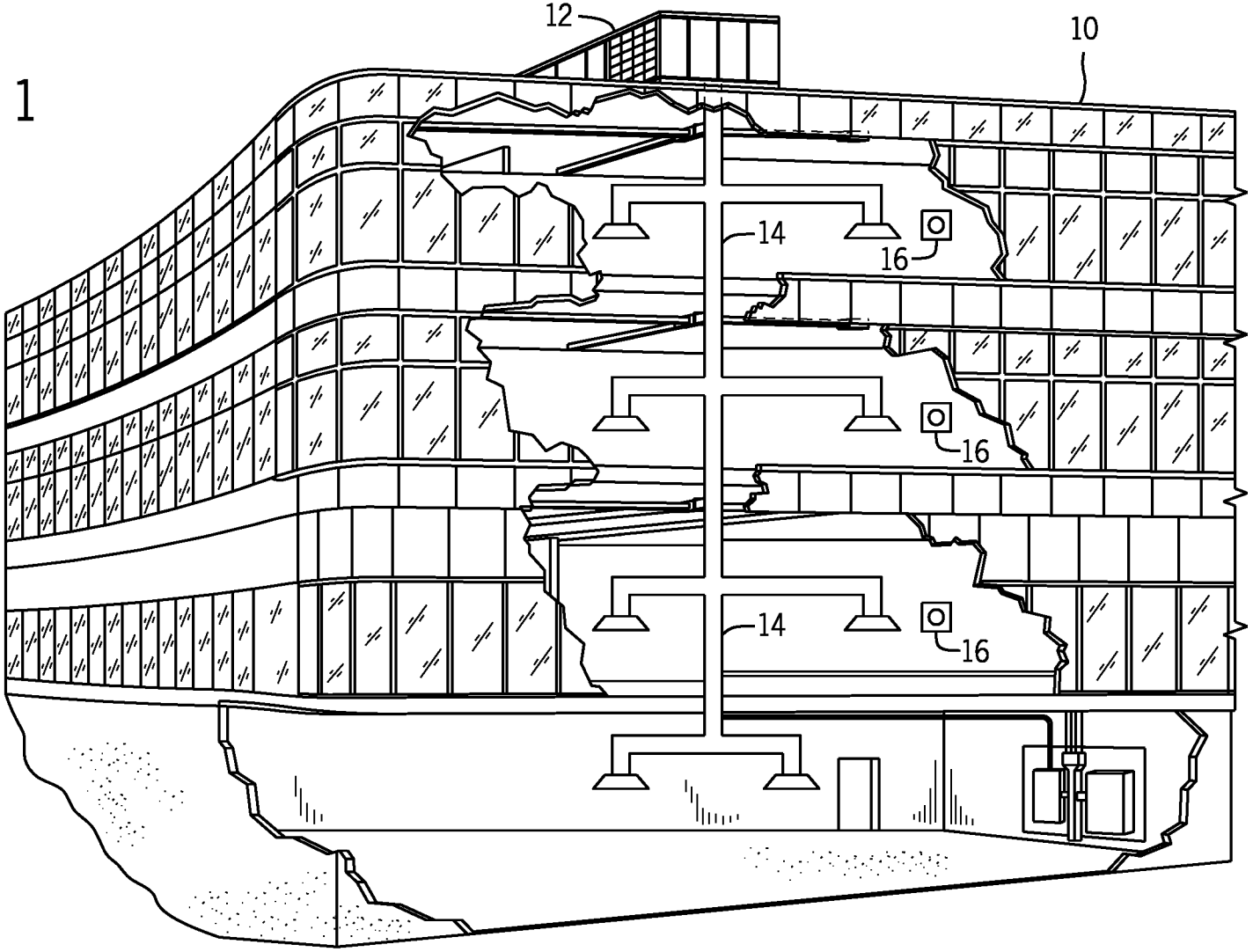
FIG. 1 is a schematic of an embodiment of an HVAC system for building environmental management that includes an HVAC unit, in accordance with an aspect of the present disclosure.

In one embodiment of the present disclosure, a panel assembly for a heating, ventilation, and/or air conditioning (HVAC) system includes a base panel having a sheet and a flange formed around a perimeter of the sheet, where the flange includes a plurality of openings, a stiffener bracket configured to couple to the flange and reinforce the base panel, and a liner panel configured to couple to the flange and reinforce the base panel, where the plurality of openings is configured to interchangeably couple to the stiffener bracket and the liner panel.

In another embodiment of the present disclosure, a heating, ventilation, and/or air conditioning (HVAC) system includes a housing having an interior compartment configured to receive a plurality of components of the HVAC system, and a panel configured to removably couple to the housing such that the panel provides protection to the interior compartment of the housing in a coupled configuration and access to the interior compartment of the housing in a decoupled configuration. The panel includes a sheet forming a wall of the panel and a flange extending from and surrounding the sheet and having a plurality of openings, where the flange is configured to alternatively couple to a stiffener bracket via a first plurality of fasteners engaging the plurality of openings or a liner panel via a second plurality of fasteners engaging the plurality of openings.

In a further embodiment of the present disclosure, a method of assembling a panel assembly for a heating, ventilation, and air conditioning (HVAC) system includes choosing a selected support structure from two support structures including a stiffener bracket and a liner panel and coupling the selected support structure to a base panel via engagement with a plurality of openings in a flange of the base panel that extends around a perimeter of a sheet of the base panel, where the openings are configured to engage either a first plurality of fasteners of the stiffener bracket or a second plurality of fasteners of the liner panel.

Other features and advantages of the present application will be apparent from the following, more detailed description of the embodiments, taken in conjunction with the accompanying drawings which illustrate, by way of example, the principles of the application.

DETAILED DESCRIPTION

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

The present disclosure is directed to an adjustable panel, or access panel, for a heating, ventilation, and/or air conditioning (HVAC) system. As set forth above, existing HVAC systems may include either a single wall panel or a double walled panel, depending on the application of the HVAC system and/or whether the HVAC system should be free from contaminants. For example, in some cases, the HVAC system may be utilized to cool various electronic components disposed in space conditioned by the HVAC system, where the presence of particles or other contaminants may affect a performance of the electronic components. As such, the HVAC system may include the double walled panel in order to facilitate cleaning of the panel and/or to restrict particles from insulation of the panel from reaching the electronic components. For example, the double walled panel may include a cover or liner that covers an insulation layer of the panel to facilitate cleaning and/or to block exposure of particles from the insulation layer to the electronic components. In other cases, particles or other contaminants may not substantially affect performance of components disposed within the environment conditioned by the HVAC system. In these applications, the single wall panel may be suitable for use. Unfortunately, in existing HVAC systems, the single wall panel and the double walled panel are manufactured as separate components of the HVAC system, which increases manufacturing costs of the HVAC system.

Accordingly, embodiments of the present disclosure are directed to an adjustable panel for an HVAC system that may enable conversion of the panel between a single wall panel and a double walled panel. For example, the adjustable panel may include a side panel, or base panel, that includes a plurality of openings. The plurality of openings of the side panel may be configured to couple to a stiffener bracket that surrounds a perimeter of the side panel and forms a single wall configuration of the adjustable panel. Additionally, the plurality of openings of the side panel may be configured to couple to a liner panel that covers an insulation layer disposed within a recess of the side panel to form a double walled configuration of the adjustable panel. The adjustable panel may thus be manufactured as a single component, or a kit, and is configured to transition or convert between the single wall configuration and the double walled configuration, which may reduce manufacturing costs of the HVAC system.

Turning now to the drawings, FIG. 1 illustrates an embodiment of a heating, ventilation, and/or air conditioning (HVAC) system for environmental management that may employ one or more HVAC units. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by a system that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, and/or auxiliary heating unit. In other embodiments, the HVAC unit 12 may be part of a split HVAC system, such as the system shown in FIG. 3, which includes an outdoor HVAC unit 58 and an indoor HVAC unit 56.

The HVAC unit 12 is an air cooled device that implements a refrigeration cycle to provide conditioned air to the building 10. Specifically, the HVAC unit 12 may include one or more heat exchangers across which an air flow is passed to condition the air flow before the air flow is supplied to the building. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building with one refrigeration circuit configured to operate in different modes. In other embodiments, the HVAC unit 12 may include one or more refrigeration circuits for cooling an air stream and a furnace for heating the air stream.

A control device 16, one type of which may be a thermostat, may be used to designate the temperature of the conditioned air. The control device 16 also may be used to control the flow of air through the ductwork 14. For example, the control device 16 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 16 may include computer systems that are integrated with or separate from other building control or monitoring systems, and even systems that are remote from the building 10.

Figure 2:
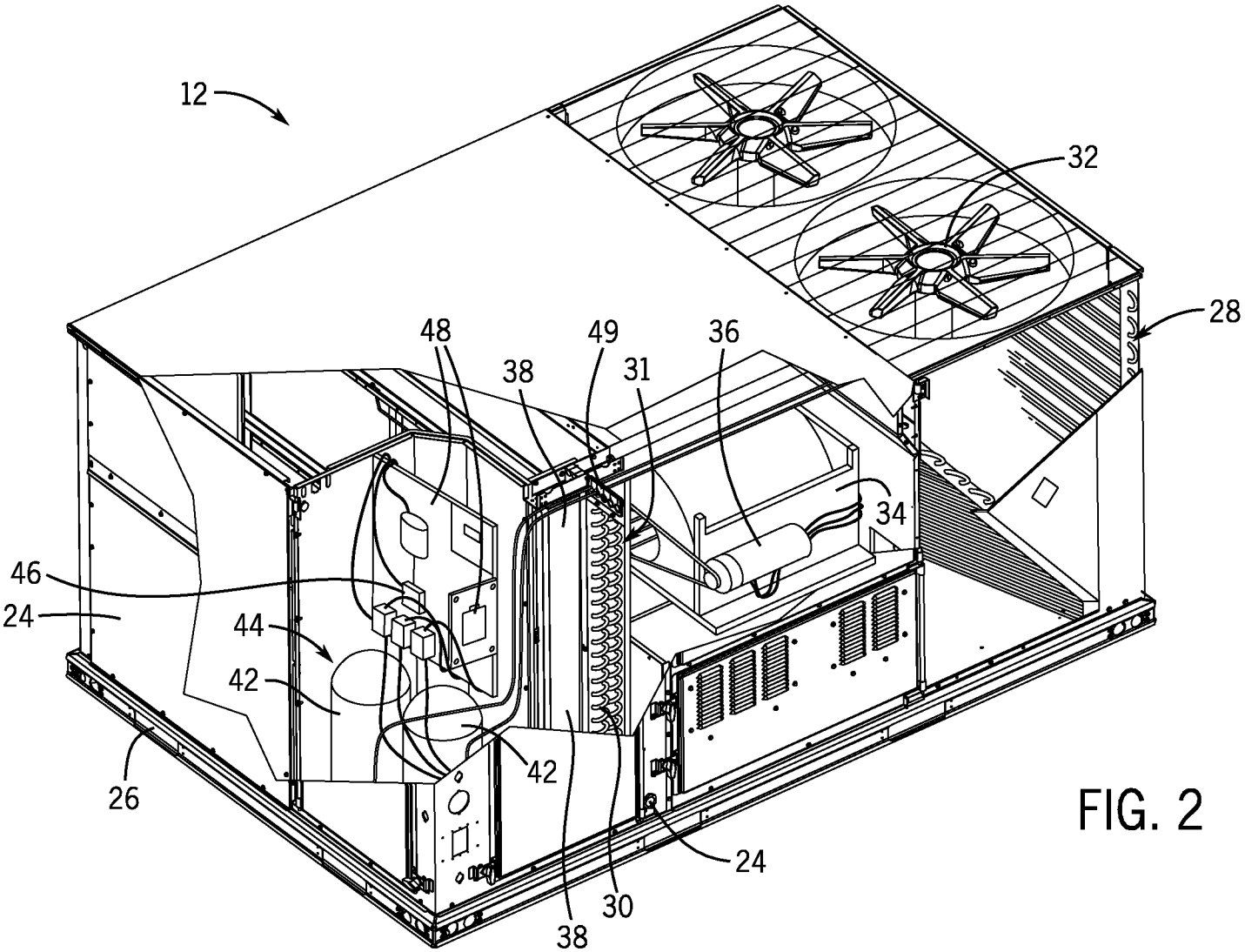
FIG. 2 is a perspective view of an embodiment of an HVAC unit that may be used in the HVAC system of FIG. 1, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

The heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the rooftop unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air flows through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 16. The control circuitry may be configured to control operation of the equipment, provide alarms, and monitor safety switches. Wiring 49 may connect the control board 48 and the terminal block 46 to the equipment of the HVAC unit 12.

Figure 3:
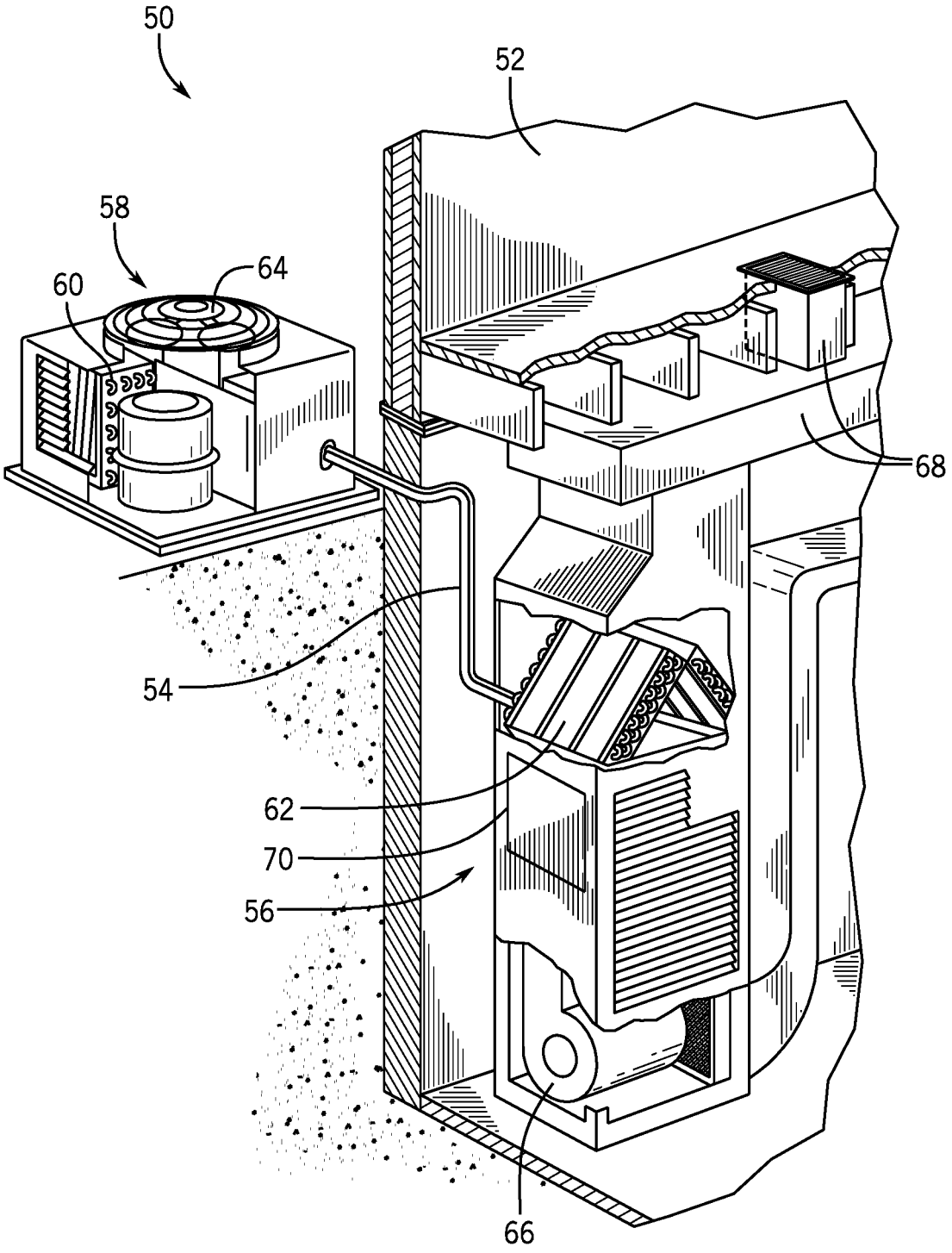
FIG. 3 is a cutaway perspective view of an embodiment of a split, residential HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or the set point plus a small amount, the residential heating and cooling system 50 may become operative to refrigerate additional air for circulation through the residence 52. When the temperature reaches the set point, or the set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over the outdoor heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

Figure 4:
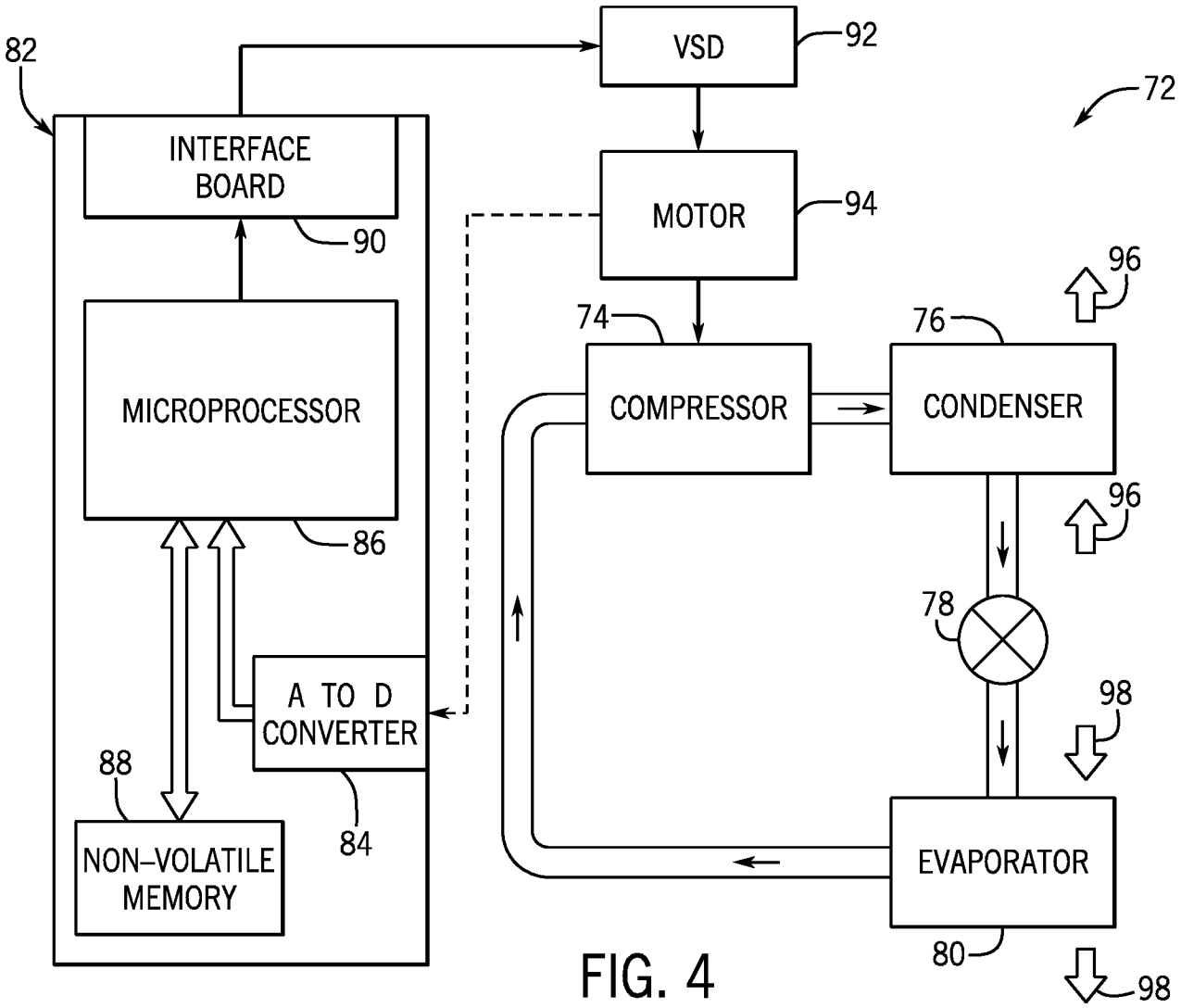
FIG. 4 is a schematic of an embodiment of a vapor compression system that can be used in any of the systems of FIGS. 1-3, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 38 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

As set forth above, embodiments of the present disclosure are directed to an adjustable panel for an HVAC system, such as the HVAC unit 12 and/or the residential heating and cooling system 50. The adjustable panel may be manufactured as a single component and is configured to transition between and/or accommodate a single wall configuration and a double walled configuration, which may reduce manufacturing costs of the HVAC system. Specifically, the adjustable panel may include a side panel that includes a plurality of openings that are configured to couple to a stiffener to form the single wall configuration and a liner to form the double walled configuration. As such, a single panel kit may be manufactured to accommodate HVAC systems that utilize either a single wall panel or a double walled panel.

Figure 5:
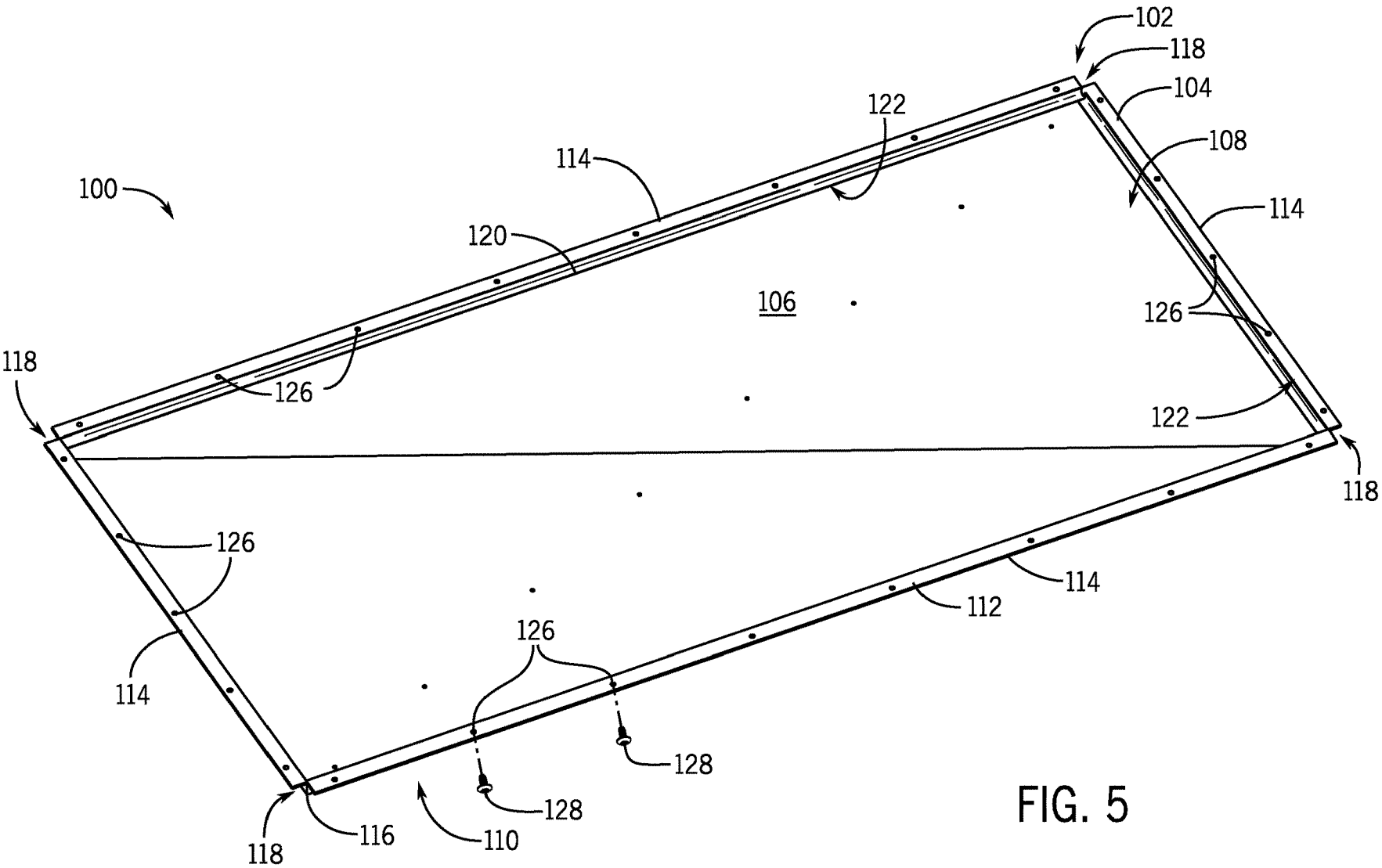
FIG. 5 is a perspective view of an embodiment of an adjustable panel for an HVAC system, illustrating a single wall configuration of the adjustable panel, in accordance with an aspect of the present disclosure.

For example, FIG. 5 is a perspective view of an embodiment of an adjustable panel 100 in a single wall configuration 102. As shown in the illustrated embodiment of FIG. 5, the adjustable panel 100 includes a side panel 104, or a first panel or base, that is configured to receive an insulation layer 106. For example, the side panel 104 may include a recess 108 that is configured to secure the insulation layer 106 within the side panel 104. The side panel 104 also includes a sheet 110 and a frame 112, or a flange, having frame segments 114, or flange segments. The frame segments 114 are disposed along a perimeter 116 of the sheet 110 and extend from the sheet 110 to ultimately form the recess 108. In some embodiments, the frame segments 114 are separated from one another by gaps 118 to enable the frame segments 114 to be cut or otherwise machined from a single piece of material that is common with the sheet 110. While the illustrated embodiment of FIG. 5 shows the adjustable panel 100 having a substantially rectangular shape, in other embodiments, the adjustable panel 100 may include any suitable shape, such as square, circular, ovular, and/or another suitable polygonal or geometric shape.

Figure 6:
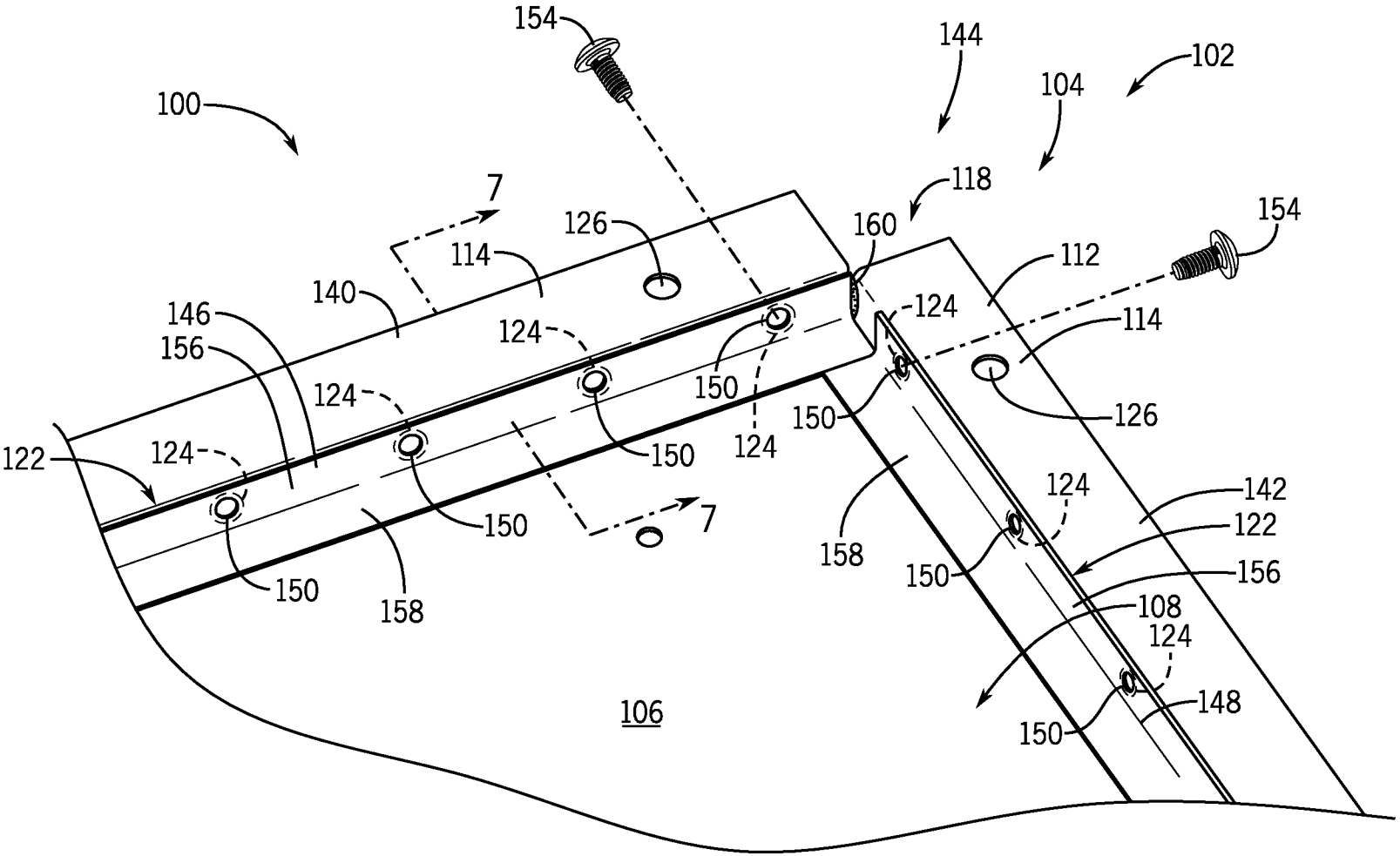
FIG. 6 is an expanded perspective view of an embodiment of the adjustable panel having the single wall configuration, in accordance with an aspect of the present disclosure.

In the single wall configuration 102, the adjustable panel 100 includes a stiffener bracket 120 that is disposed against and/or adjacent to the frame segments 114 within the recess 108. In some embodiments, the stiffener bracket 120 includes a shape and/or contour that substantially conforms to a shape of the frame 112. In other words, the stiffener bracket 120 is configured to fit within the recess 108 and contact interior surfaces 122 of the frame segments 114. As such, the stiffener bracket 120 may be coupled to the frame 112 via a plurality of openings 124, which are shown in FIG. 6, which extends through the frame segments 114 of the frame 112. In some embodiments, the stiffener bracket 120 may include a single, unitary piece of material that is configured to fit within the recess 108 formed by the frame segments 114. In other embodiments, the stiffener bracket 120 may include multiple portions or segments that are disposed within the recess 108. The stiffener bracket 120 is discussed in further detail herein with reference to FIG. 6.

As shown in the illustrated embodiment of FIG. 5, the insulation layer 106 is exposed in the single wall configuration 102. The sheet 110 of the side panel 104 may form an outer wall of the adjustable panel 100, such that the insulation layer 106 is disposed within and facing an interior compartment of a housing of the HVAC system, such as the cabinet 24, to which the adjustable panel 100 is coupled. The insulation layer 106 may block or restrict thermal energy transfer between an ambient environment surrounding the housing of the HVAC system and the components and/or fluids within the housing of the HVAC system. In some cases, the adjustable panel 100 may be removably coupled to the housing of the HVAC system to provide access to components within the housing. As such, the adjustable panel 100 may be an access panel that enables an operator to perform maintenance, repair, replace, and/or access the components within the housing. For example, the frame segments 114 may include a plurality of coupling openings 126 and/or openings that may be configured to receive fasteners 128 that extend through the frame segments 114 and into a wall or structural component of the housing of the HVAC system.

FIG. 6 is an expanded perspective view of an embodiment of the adjustable panel 100 in the single wall configuration 102. As shown in the illustrated embodiment of FIG. 6, a first frame segment 140 and a second frame segment 142 form a corner 144 of the adjustable panel 100 and/or the frame 112. As set forth above, the gap 118 may be formed between the first frame segment 140 and the second frame segment 142 as a result of forming the frame segments 114 from a common piece of material with the sheet 110 of the side panel 104. In other words, the common piece of material may be cut and bent and/or otherwise manipulated to form the sheet 110, the frame segments 114, and the recess 108. The stiffener bracket 120 includes a first portion 146 and a second portion 148 that are configured to block or cover the gap 118 between the first frame segment 140 and the second frame segment 142. As such, the stiffener bracket 120 may block air and/or contaminants from flowing across the adjustable panel 100, and thus into and/or out of the housing of the HVAC system, via the gap 118. The stiffener bracket 120 may cover the gap 118 without utilizing a sealant, while providing additional support to the adjustable panel 100. In other embodiments, a sealant may be disposed at the corners 144 of the side panel 104 in order to further block air and/or contaminants from flowing into or out of the interior of the housing. In such embodiments, a reduced amount of sealant may be utilized when compared to existing HVAC systems because the stiffener bracket 120 substantially spans and/or covers the gaps 118 formed at the corners 144, such that an amount of sealant used for sealing the gaps 118 is reduced.

In the illustrated embodiment of FIG. 6, the first portion 146 and the second portion 148 of the stiffener bracket 120 are separate components that are disposed into the recess 108 of the adjustable panel 100. The insulation layer 106 is captured between the sheet 110 and the stiffener bracket 120 to secure the insulation layer 106 within the recess 108. Further, the stiffener bracket 120 may block delamination of the insulation layer 106 to restrict particles or fibers of the insulation layer 106 from entering the interior compartment of the HVAC system, and thus, restrict and/or prevent the particles or fibers from being introduced into an air stream flowing through the HVAC system. In some embodiments, the first portion 146 and the second portion 148 of the stiffener bracket 120 may be coupled to one another via a weld, an adhesive, and/or a fastener. In other embodiments, the first portion 146 and the second portion 148 of the stiffener bracket 120 may not be coupled to one another, but may be secured in place within the recess 108 by coupling the first portion 146 to the first frame segment 140 and coupling the second portion 148 to the second frame segment 142. Additionally or alternatively, the first portion 146 of the stiffener bracket 120 may be coupled to both the first frame segment 140 and the second frame segment 142 to couple the first and second frame segments 140, 142 to one another. In any case, the stiffener bracket 120 may include a plurality of openings 150 configured to be aligned with the corresponding plurality of openings 124 extending through the frame segments 114. A plurality of fasteners 154 may extend through the plurality of openings 150 and the corresponding plurality of openings 124 to secure the stiffener bracket 120 to the frame 112 and thus within the recess 108 of the adjustable panel 100. In other embodiments, the stiffener bracket 120 may be coupled to the frame 112 of the adjustable panel 100 via another suitable technique, such as an adhesive, a friction interference fit, a snap engagement, or a combination thereof.

In any case, the stiffener bracket 120 is configured to provide structural support to the adjustable panel 100 and/or secure the insulation sheet 106 within the recess 108. For example, the stiffener bracket 120 may provide structural support to the adjustable panel 100 by reinforcing the frame 112 and/or forming a skeletal structure within the recess 108 to further distribute forces applied to the adjustable panel 100 to the stiffener bracket 120. The stiffener bracket 120 may include a first flange 156 and a second flange 158 that extends in a direction transverse to the first flange 156. For example, the first flange 156 and the second flange 158 of the stiffener bracket 120 may extend from one another at a substantially 90 degree angle to form an L-shape cross section. The first flange 156 may abut the interior surfaces 122 of the frame segments 114 and may facilitate coupling of the stiffener bracket 120 to the frame 112. Further, the second flange 158 may extend across, abut, or be positioned adjacent to the insulation layer 106, which is captured between the stiffener bracket 120 and the sheet 110. The second flange 158 may distribute forces that are applied to the adjustable panel 100 and provide additional structural support to the adjustable panel 100.

In some embodiments, a sealant 160 may be disposed at the gap 118 formed between the first frame segment 140 and the second frame segment 142. The sealant 160 may be utilized to further block air and/or contaminants from flowing across the adjustable panel 110 and therefore into and/or out of the interior of the housing of the HVAC system to which the adjustable panel 100 is coupled. For example, in some cases, the stiffener bracket 120 may not fully cover the gap 118, such that the sealant 160 is utilized to fill and seal the gap 118. Additionally or alternatively, a space may be formed between the frame segments 114 and the stiffener bracket 120, which may be filled with the sealant 160. The sealant 160 may include an epoxy, a silica-based sealant, caulk, and/or another suitable material that may block air and/or other contaminants from flowing through the gap 118. As set forth above, an amount of sealant 160 disposed within the gap 118 may be reduced when compared to existing HVAC systems because the stiffener bracket 120 may at least partially cover the gap 118, which decreases an amount of sealant 160 used to cover the gap 118.

Figure 7:
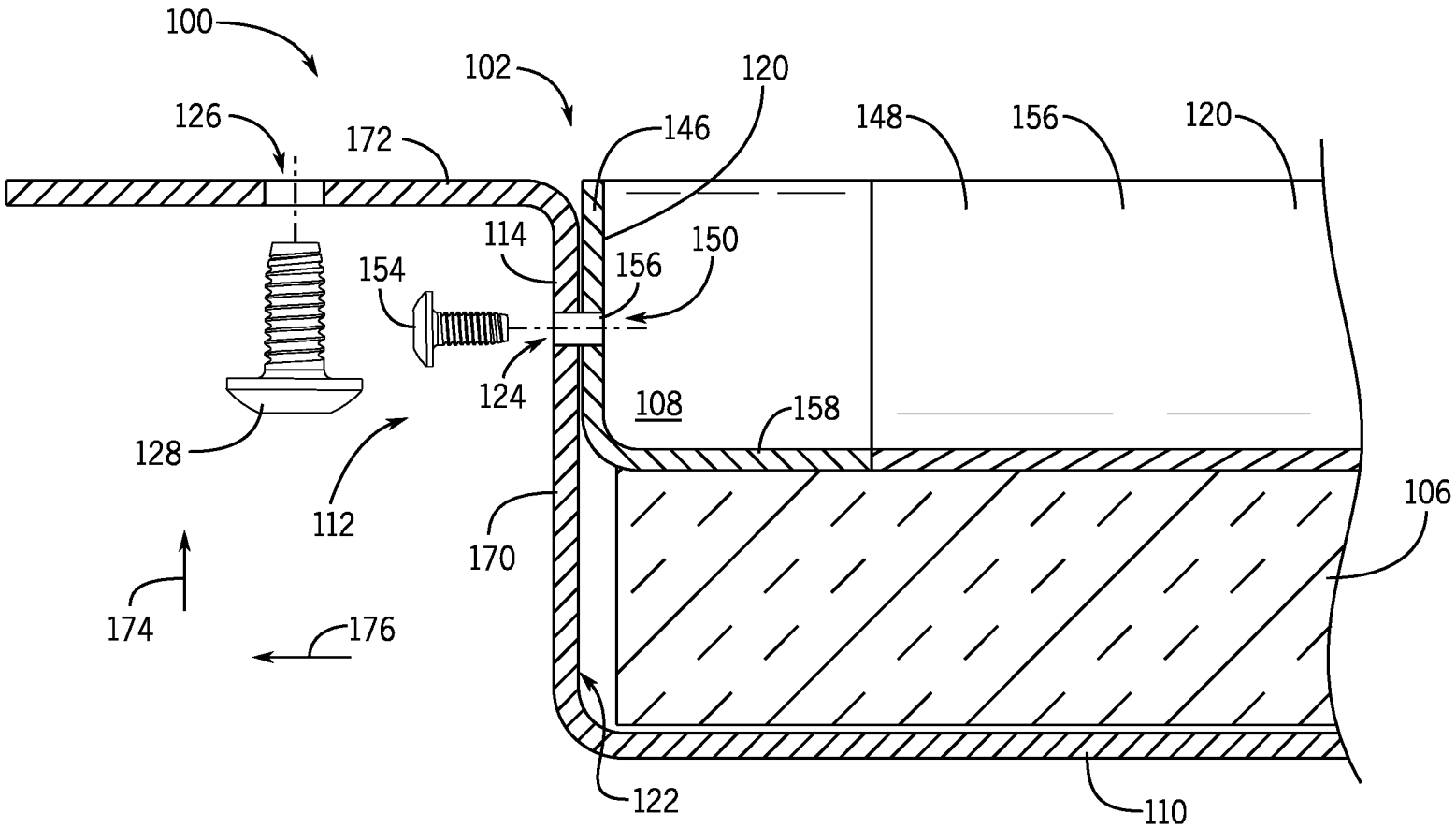
FIG. 7 is a cross-section of an embodiment of the adjustable panel having the single wall configuration, in accordance with an aspect of the present disclosure.

FIG. 7 is a cross-section of an embodiment of the adjustable panel 100 in the single wall configuration 102. As shown in the illustrated embodiment of FIG. 7, the sheet 110 of the side panel 104 forms a base of the recess 108, in which the insulation layer 106 is disposed. As set forth above, the sheet 110 may also form an external surface 168 of the housing of the HVAC system, and the insulation layer 106 and/or the stiffener bracket 120 are disposed on a side of the sheet 110 opposite the exterior surface 168, such that the insulation layer 106 and/or the stiffener bracket 120 are disposed within an interior of the housing to which the adjustable panel 100 is coupled. The frame segments 114 of the frame 112 include an extension portion 170 and a coupling flange 172. The extension portion 170 may extend from the sheet 110 in a direction 174 that is transverse to a direction 176 along which the sheet 110 extends. As such, the extension portion 170 of the frame segments 114 and the sheet 110 form the recess 108 which receives the insulation layer 106. Further, the coupling flange 172 extends in the direction 176 from the extension portion 170, such that the coupling flange 172 and the sheet 110 are substantially parallel with one another in the direction 176. The coupling flange 172 may include the plurality of coupling openings 126 that are configured to receive the fasteners 128 to couple the adjustable panel 100 to the housing of the HVAC system. The fasteners 128 may be removed from the plurality of coupling openings 126 and/or the housing of the HVAC system to enable removal of the adjustable panel 100 and provide access to the interior of the housing.

In some embodiments, the stiffener bracket 120 is coupled to the frame segments 114 via the plurality of fasteners 154 that are configured to extend through the plurality of openings 150 of the stiffener bracket 120 and the corresponding plurality of openings 124 of the frame segments 114. As set forth above, in other embodiments, the stiffener bracket 120 may be coupled to the frame segments 114 via another suitable coupling technique, such as a weld, an adhesive, a friction interference fit, a snap engagement, or any combination thereof. In any case, the stiffener bracket 120 is configured to cover and/or block the gap 118 formed between adjacent frame segments 114 to block or restrict air and/or contaminants from entering or exiting the housing of the HVAC system.

Figure 8:
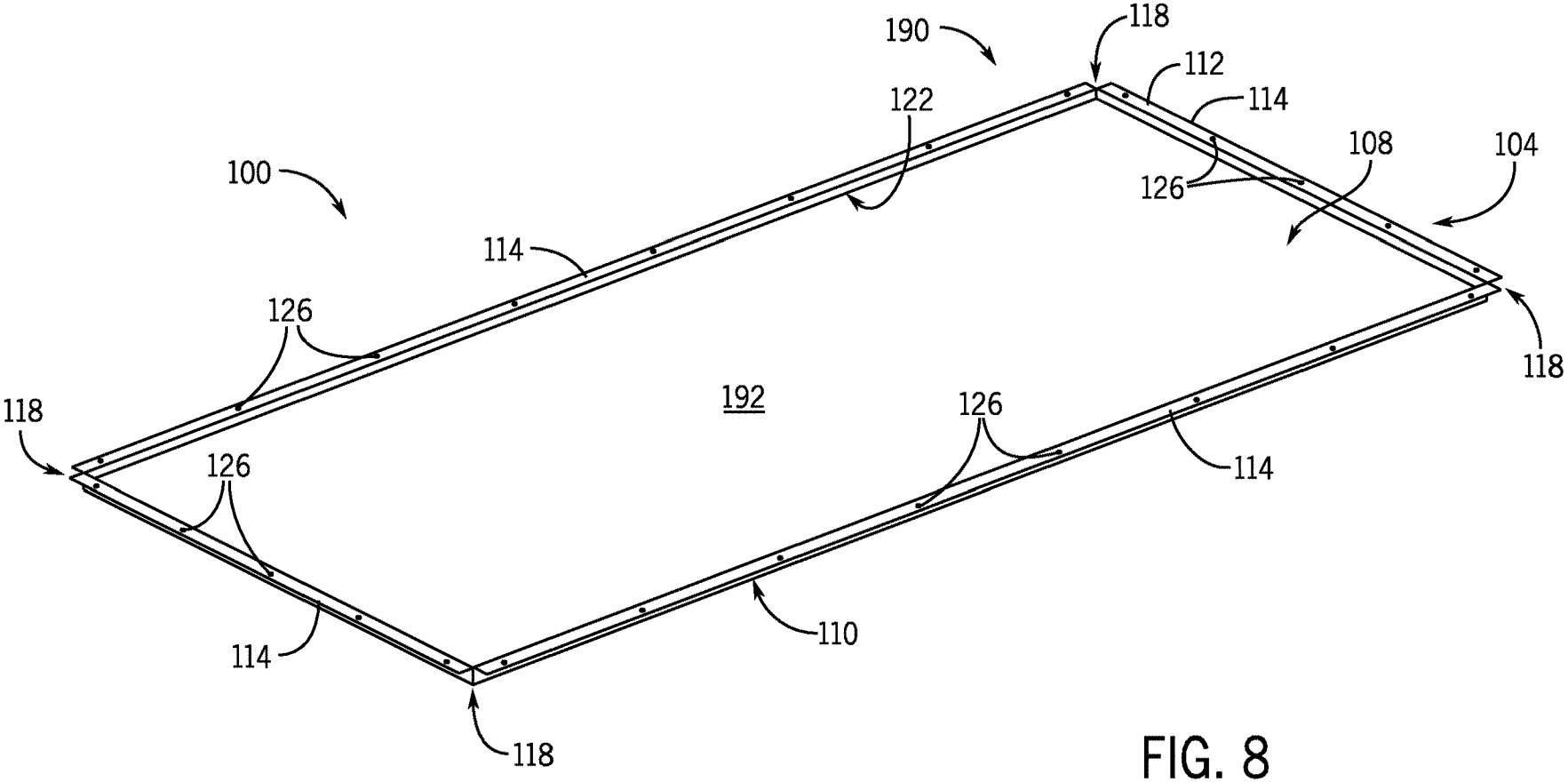
FIG. 8 is a perspective view of an embodiment of the adjustable panel having a double walled configuration, in accordance with an aspect of the present disclosure.

FIG. 8 is a perspective view of an embodiment of the adjustable panel 100 in a double walled configuration 190. As shown in the illustrated embodiment of FIG. 8, the adjustable panel 100 includes the side panel 104 having the sheet 110 and the frame 112. In the double walled configuration 190, the adjustable panel 100 further includes a liner panel 192 that is disposed within the recess 108 and over the insulation layer 106. As such, the insulation layer 106 is covered by the liner panel 192 to facilitate cleaning of the adjustable panel 100 and to block particles or other portions of the insulation layer 106 from being exposed to the interior of the housing of the HVAC system to which the adjustable panel 100 is coupled. For example, the liner panel 192 may block water and/or other cleaning fluids from contacting the insulation layer 106, such that an exterior of the doubled walled configuration 190 of the adjustable panel 100 may be cleaned with relative ease. Additionally, the liner panel 192 blocks portions or particles of the insulation layer 106 from mixing with an air flow within the interior of the housing, thereby reducing an amount of particles and/or contaminants that may be directed toward an environment to be conditioned by the HVAC system.

Figure 9:
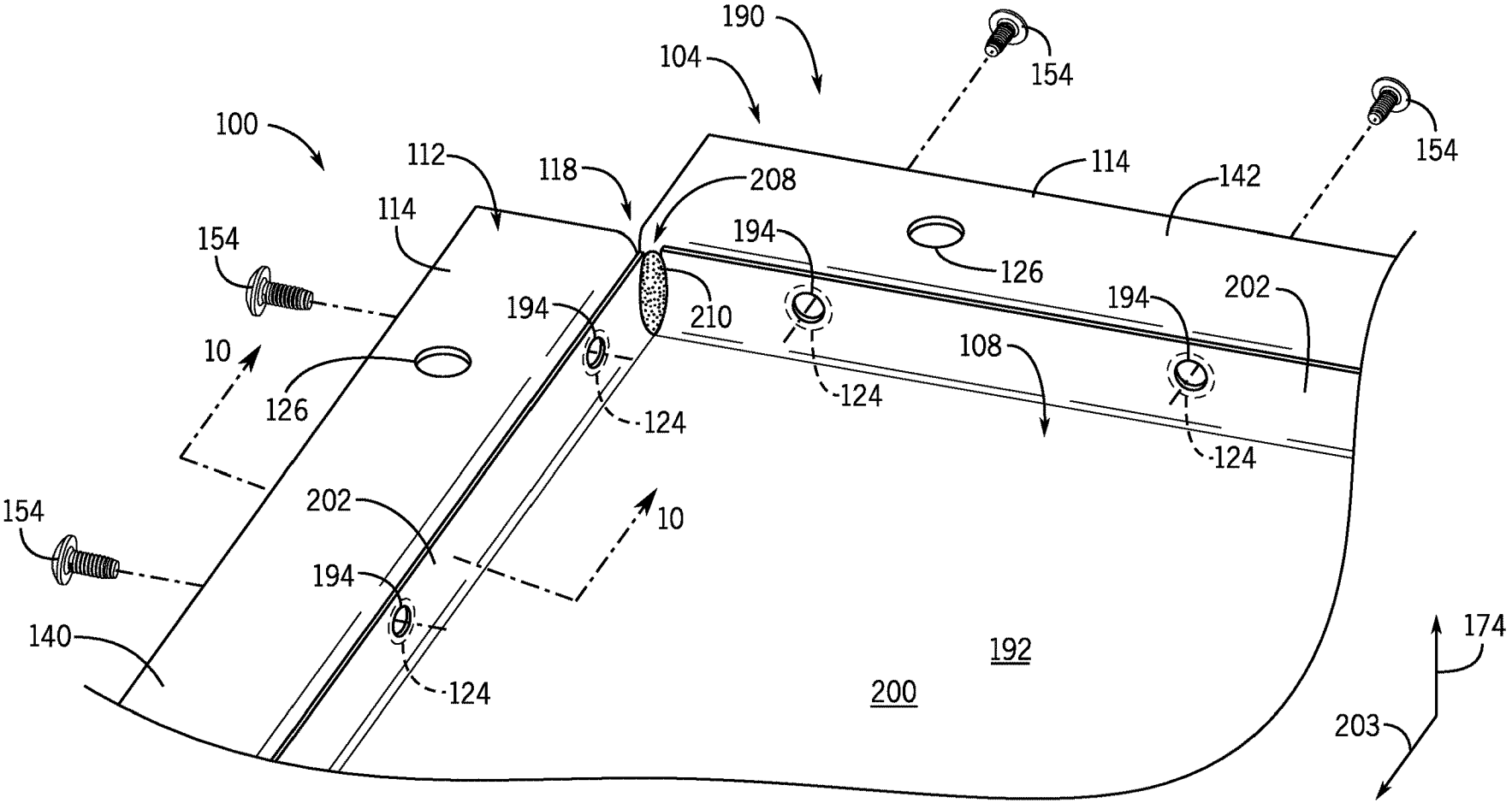
FIG. 9 is an expanded perspective view of an embodiment of the adjustable panel having the double walled configuration, in accordance with an aspect of the present disclosure.

The liner panel 192 is configured to fit within the recess 108 and be positioned proximate or adjacent to the frame segments 114 to enable the liner panel 192 to be coupled to the frame 112. For example, the liner panel 192 may include a plurality of openings 194, which are shown in FIG. 9, that align with the corresponding plurality of openings 124 of the frame segments 114. As such, the plurality of fasteners 154 may be inserted into the plurality of openings 194 and the corresponding plurality of openings 124 to couple the liner panel 192 to the frame 112, and thus, the side panel 104. In some embodiments, the corresponding plurality of openings 124 is used to couple both the stiffener bracket 120 and the liner panel 192 to the frame segments 114 of the side panel 104. Thus, a single side panel 104 may accommodate both the single wall configuration 102 and the double walled configuration 190 of the adjustable panel 100. In other words, the single side panel 104 may be readily converted between the single wall configuration 102 and the double walled configuration 190.

FIG. 9 is an expanded perspective view of the adjustable panel 100 in the double walled configuration 190. As shown in the illustrated embodiment of FIG. 9, the liner panel 192 includes a cover sheet 200 and flanges 202 extending from the cover sheet 200. The cover sheet 200 is configured to be disposed over and cover the insulation layer 106 within the recess 108 of the side panel 104. In this manner, the insulation layer 106 is captured and secured between the sheet 110 of the side panel 104 and the cover sheet 200 of the liner panel 192. Further, the flanges 202 may facilitate coupling of the liner panel 192 to the frame segments 114. In some embodiments, the cover sheet 200 and the flanges 202 are formed from a single, unitary piece of material. For example, the single, unitary piece of material may be cut and manipulated to form the flanges 202, which extend in the direction 174 transverse to a direction 203 along which the cover sheet 200 extends. In other embodiments, the flanges 202 may be separate components from the cover sheet 200 and may be coupled to the cover sheet 200 via a weld, an adhesive, fasteners, or another suitable coupling technique. In any case, the flanges 202 include the plurality of openings 194, which enable the liner panel 192 to be coupled to the frame segments 114 via the corresponding plurality of openings 124 and the plurality of fasteners 154. As such, the corresponding plurality of openings 124 of the side panel 104 may be utilized to couple both the stiffener bracket 120 and the liner panel 192 to the side panel 104. Therefore, the side panel 104 may be manufactured as a single component that is configured to couple to both the stiffener bracket 120 and the liner panel 192.

In some embodiments, adjacent flanges 202 of the liner panel 192 may form a gap 208. However, a portion of the liner panel 192 is configured to partially cover the gaps 118 formed between the frame segments 114. In such embodiments, a sealant 210 may be disposed within the gaps 118 and/or the gap 208 in order to block air and/or contaminants from flowing into or out of the interior of the housing via the adjustable panel 100. For example, the sealant 210 may be disposed within the gaps 118 and/or the gap 208 to block air and/or contaminants from flowing through the gaps 118, 208. The sealant 210 may include an epoxy, a silica-based sealant, caulk, and/or another suitable material. Additionally or alternatively, the sealant 210 may be disposed between the liner panel 192 and the frame segments 114 to provide a water-tight and/or air-tight seal and block water or other fluids from contacting the insulation layer 106.

Figure 10:
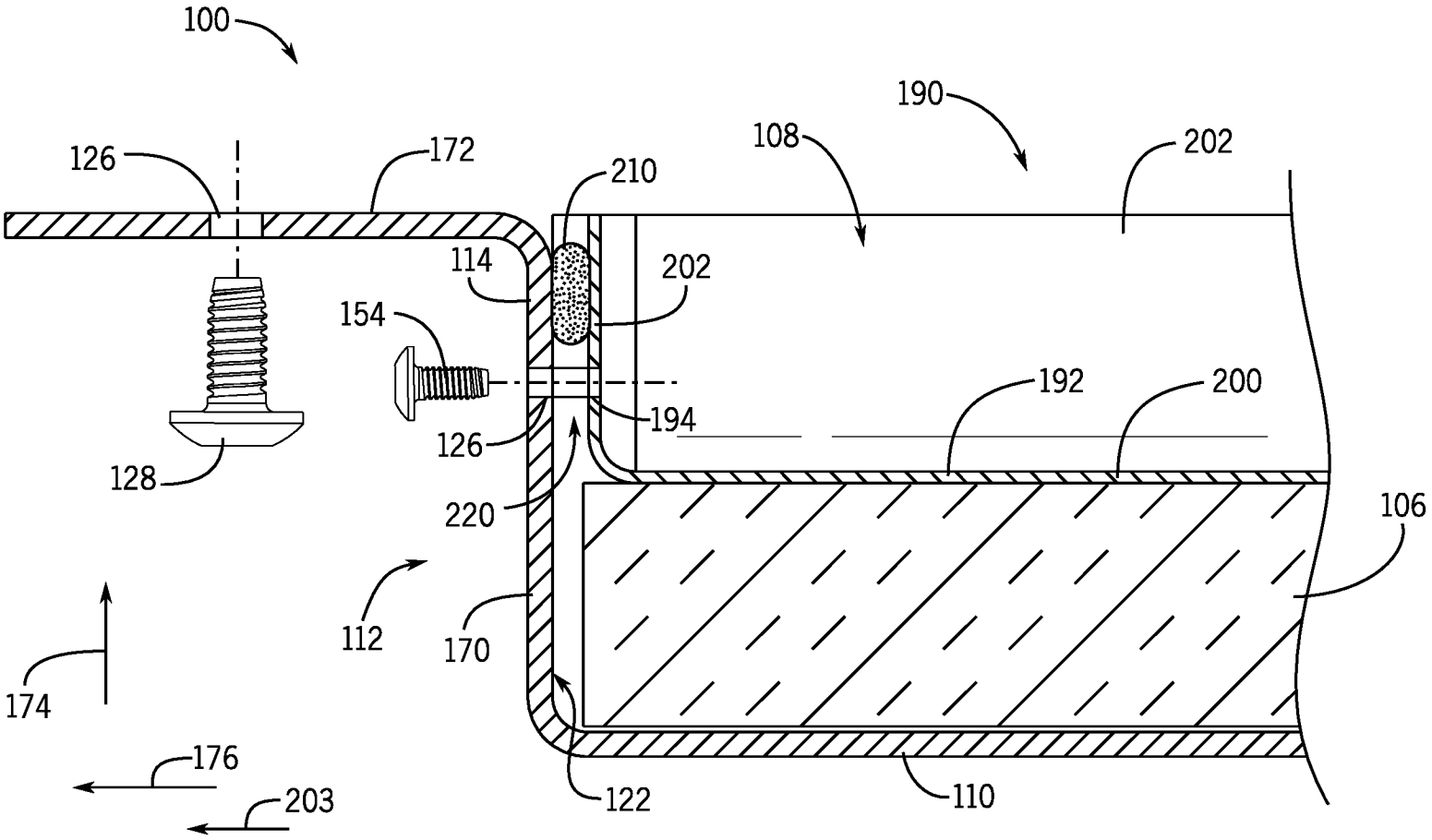
FIG. 10 is a cross-section of an embodiment of the adjustable panel having the double walled configuration, in accordance with an aspect of the present disclosure.

FIG. 10 is a cross-section of an embodiment of the adjustable panel 100 in the double walled configuration 190. As shown in the illustrated embodiment of FIG. 10, the liner panel 192 is disposed within the recess 108 formed by the sheet 110, the extension portion 170 of the frame segments 114, and/or the coupling portion 172 of the frame segments 114. The cover sheet 200 may be configured to press against and contact the insulation layer 106, such that the insulation layer 106 is secured and captured between the sheet 110 and the liner panel 192. In other embodiments, the cover sheet 200 is positioned above or offset from the insulation layer 106 with respect to the direction 174. In any case, the cover sheet 200 may extend in the direction 176 and be substantially parallel to the insulation layer 106.

The flanges 202 of the liner panel 192 may extend in the direction 174 from the cover sheet 200 and align with a portion of the extension portion 170 of the frame segments 114. As such, the plurality of openings 194 may be aligned with the corresponding plurality of openings 124 of the frame segments 114, thereby enabling the liner panel 192 to be coupled to the side panel 104 via the plurality of fasteners 154. As set forth above, the sealant 210 may be disposed within a space 220 between the flanges 202 of the liner panel 192 and the extension portion 170 of the frame segments 114. The sealant 210 may block water and/or other fluids utilized to clean the cover sheet 200 from contacting or flowing toward the insulation layer 106. Therefore, the adjustable panel 100 is configured to be cleaned without affecting the insulation layer 106. In any case, the adjustable panel 100 may be converted between the single wall configuration 102 and the double walled configuration 190, which may reduce manufacturing costs and facilitate assembly of the HVAC system.

As set forth above, embodiments of the present disclosure may provide one or more technical effects useful in facilitating manufacturing of an HVAC system. For example, embodiments of the present disclosure are directed to an adjustable panel that is configured to transition between a single wall configuration and a double walled configuration depending on a particular application of the HVAC system. For example, the adjustable panel may include a side panel having a sheet and frame segments that form a recess. An insulation layer is configured to be disposed within the recess to block thermal energy from transferring between an interior portion of a housing of the HVAC system and an environment surrounding the housing to which the adjustable panel is coupled. A stiffener bracket may be coupled to the frame segments of the side panel in the single wall configuration. For example, the stiffener bracket may be coupled to the frame segments via a plurality of fasteners that extend through a plurality of openings of the stiffener bracket and through a corresponding plurality of openings of the frame segments. Further, a liner panel may be coupled to the frame segments, such as in lieu of the stiffener bracket, in the double walled configuration. The liner panel may also be coupled to the frame segments via the plurality of fasteners configured to extend through a plurality of openings of the liner panel and through the corresponding plurality of openings of the frame segments. As such, the side panel may be manufactured to accommodate both single wall and double walled housings of the HVAC system, and the adjustable panel may be readily converted between the single wall configuration and the double walled configuration. As a result, manufacturing costs of the HVAC system may be reduced, because the adjustable panel may be configured for multiple HVAC system housings and applications. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure. Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The invention claimed is:

1. A panel assembly for a heating, ventilation, and/or air conditioning (HVAC) system, comprising:

a base panel including a sheet and a flange formed around a perimeter of the sheet, wherein the flange includes a plurality of openings;

a stiffener bracket configured to couple to the flange within the perimeter of the sheet and reinforce the base panel; and a liner panel configured to couple to the flange within the perimeter of the sheet and reinforce the base panel, wherein the plurality of openings is configured to interchangeably couple to the stiffener bracket and the liner panel.

2. The panel assembly of claim 1, wherein the flange includes gaps formed between segments of the flange.

3. The panel assembly of claim 2, wherein the stiffener bracket includes an L-shaped flange configured to span one of the gaps and couple with two segments of the flange.

4. The panel assembly of claim 1, wherein the sheet is configured to form a first wall of a double-wall panel, the liner panel is configured to form a second wall of the double-wall panel, and an insulation layer is disposed between the first and second walls.

5. The panel assembly of claim 4, wherein the first wall is configured to be an outer wall of the HVAC system, and the second wall is configured to be an inner wall of the HVAC system.

6. The panel assembly of claim 1, comprising the stiffener bracket coupled to the flange via the plurality of openings and a plurality of fasteners, wherein the stiffener bracket extends between each gap of a plurality of gaps formed between segments of the flange.

7. The panel assembly of claim 1, wherein the stiffener bracket includes a first plurality of fasteners, the liner panel includes a second plurality of fasteners, and the plurality of openings is configured to be interchangeably engaged with both the first plurality of fasteners and the second plurality of fasteners, and wherein the plurality of openings is configured to be engaged with only the first plurality of fasteners or only the second plurality of fasteners at one time.

8. The panel assembly of claim 1, wherein the sheet has a length, the flange includes an extension portion extending in a first direction transverse to the length of the sheet and includes a coupling portion extending in a second direction, transverse to the first direction.

9. The panel assembly of claim 8, wherein the coupling portion of the base panel is configured to couple the base panel to a housing of the HVAC system.

10. The panel assembly of claim 9, wherein the base panel is configured to be removably coupled to the housing of the HVAC system to form an access panel of the HVAC system.

11. The panel assembly of claim 8, wherein the extension portion and the sheet of the base panel are configured to form a recess configured to receive an insulation layer.

12. The panel assembly of claim 11, comprising the insulation layer, wherein the insulation layer is configured to be disposed between the sheet of the base panel and the stiffener bracket or between the sheet of the base panel and the liner panel.

13. The panel assembly of claim 12, comprising a sealant disposed between a space formed between the flange and the liner panel, wherein the sealant is configured to block a flow of fluid between the flange and the liner panel toward the insulation layer.

14. The panel assembly of claim 12, wherein the insulation layer is configured to be disposed between the sheet of the base panel and the stiffener bracket such that the stiffener bracket blocks delamination of the insulation layer.

15. The panel assembly of claim 1, comprising a sealant configured to be disposed at gaps formed between segments of the flange.

16. A heating, ventilation, and/or air conditioning (HVAC) system, comprising:

a housing having an interior compartment configured to receive a plurality of components of the HVAC system; and a panel configured to removably couple to the housing such that the panel provides protection to the interior compartment of the housing in a coupled configuration and access to the interior compartment of the housing in a decoupled configuration, wherein the panel comprises:

a sheet forming a wall of the panel; and a flange extending from and surrounding the sheet and having a first plurality of openings, wherein the flange is configured to alternatively couple to a stiffener bracket via a first plurality of fasteners engaging the first plurality of openings or to a liner panel via a second plurality of openings formed in the liner panel and a second plurality of fasteners engaging the first and second pluralities of openings.

17. The HVAC system of claim 16, comprising the stiffener bracket coupled to the flange, wherein the stiffener bracket includes an L-shaped flange configured to cover gaps formed between segments of the flange.

18. The HVAC system of claim 17, comprising an insulation layer disposed between the sheet of the panel and the stiffener bracket, wherein the stiffener bracket is configured to block delamination of the insulation layer.

19. The HVAC system of claim 16, comprising the liner panel coupled to the flange, wherein the wall is a first wall, and the liner panel is configured to form a second wall of the panel.

20. The HVAC system of claim 19, wherein the first wall is an outer wall of the panel, and wherein the second wall is an inner wall of the panel.

21. The HVAC system of claim 16, wherein the sheet has a length, the flange includes an extension portion extending in a first direction transverse to the length of the sheet and includes a coupling portion extending in a second direction, transverse to the first direction.

22. The HVAC system of claim 21, wherein the coupling portion is configured to couple the panel to the housing.

23. A method of assembling a panel assembly for a heating, ventilation, and air conditioning (HVAC) system, comprising:

choosing a selected support structure from two support structures including a stiffener bracket and a liner panel; and coupling the selected support structure to a base panel via engagement with a plurality of openings in a flange of the base panel that extends around a perimeter of a sheet of the base panel, wherein the openings are configured to engage either a first plurality of fasteners of the stiffener bracket or a second plurality of fasteners of the liner panel, wherein the selected support structure is configured to couple to the base panel within the perimeter of the sheet of the base panel.

24. The method of assembling the panel assembly of claim 23, comprising forming the base panel having the sheet and the flange extending around the perimeter of the sheet.

25. The method of assembling the panel assembly of claim 23, comprising forming the plurality of openings in the flange.

26. The method of assembling the panel assembly of claim 23, comprising disposing an insulation layer in a recess of the base panel, such that the insulation layer is captured between the sheet and the stiffener bracket in a single wall configuration or is captured between the sheet and the liner panel in a double-walled configuration.

27. The method of assembling the panel assembly of claim 26, comprising choosing the stiffener bracket as the selected support structure, coupling the stiffener bracket to the base panel via the plurality of openings in the flange of the base panel and the first plurality of fasteners, and blocking delamination of the insulation layer with the stiffener bracket.

28. The method of assembling the panel assembly of claim 23, comprising disposing a sealant between the flange and the liner panel to block a flow of fluid between the flange and the liner panel.

29. The method of assembling the panel assembly of claim 23, comprising disposing a sealant between corners of the flange formed around the perimeter of the sheet and the stiffener bracket.

* * * * *